United States Patent [19]

Stöger et al.

[11] 4,066,515

[45] Jan. 3, 1978

[54] APPARATUS AND METHOD FOR THE ELECTRODEPOSITING OF ALUMINUM

[75] Inventors: Klaus Stöger; Richard Dötzer, both of Nurnberg; Johann Gehring, Spardorf near Erlangen, all of Germany

[73] Assignee: Siemens Aktiengesellschaft, Berlin & Munich, Germany

[21] Appl. No.: 713,984

[22] Filed: Aug. 12, 1976

[30] Foreign Application Priority Data

Aug. 21, 1975 Germany ..... 2537285

[51] Int. Cl.[2] ..... C25D 5/00; C25D 5/04

[52] U.S. Cl. ..... 204/14 N; 204/237; 204/213

[58] Field of Search ..... 204/14 N, 275, 213, 204/237

[56] References Cited

U.S. PATENT DOCUMENTS

| | | | |
|---|---|---|---|
| 2,962,427 | 11/1960 | Kosowsky | 204/34 |
| 3,776,827 | 12/1973 | Inoue | 204/213 |
| 3,972,784 | 8/1976 | Dötzer et al. | 204/14 N |

*Primary Examiner*—John H. Mack
*Assistant Examiner*—H. A. Feeley
*Attorney, Agent, or Firm*—Kenyon & Kenyon, Reilly, Carr & Chapin

[57] ABSTRACT

Apparatus for electrodepositing aluminum from aprotic, oxygen-free and water-free organo-aluminum electrolytes in which a heatable treatment tank is closed off in an airtight manner and contains a rotatable electroplating drum with a first heatable tank for storing an aprotic oxygen-free and water-free organo-aluminum electrolyte and a second tank for storing a rinsing liquid connected to the treatment tank.

10 Claims, 3 Drawing Figures

APPARATUS AND METHOD FOR THE ELECTRODEPOSITING OF ALUMINUM

BACKGROUND OF THE INVENTION

The invention relates to apparatus for electrodepositing aluminum from aprotic, oxygen-free and water-free organo-aluminum electrolytes in general and more particularly to improved apparatus of this nature.

Aluminum electrodeposited from aprotic, oxygen-free and water-free organo-aluminum electrolytes has been found highly suitable for many engineering purposes because of its ductility, freedom from pores, corrosion resistance and ability to be anodized. Such electrolytes, which are known, for instance, from U.S. Pat. Nos. 3,448,127 and 3,418,216 and British patent specification No. 1,001,482, are prepared and stored under oxygen-free and water-free conditions. Since the access of air causes a considerable reduction of the conductivity and the life of these electrolytes because the electrolyte reacts with the oxygen and the moisture of the air, the electrolyte bath must be protected from contact with air as thoroughly as possible. Attemptes to carry out the electrodeposition of aluminum in known electroplating apparatus and to accomplish the exclusion of air by covering the electrolytic bath with protective liquids such as paraffin oil or inert gases such as nitrogen, however, have not led to satisfactory results. Such coverings do not provide a reliable protection of the electrolytic bath, since they are repeatedly torn open when the articles to be electroplated are inserted and removed as well as when the electrolyte and/or the articles move. Such operations thus permit air to come into contact with the electrolyte. In addition, the use of an inert gas for protection is not possible since inert gases mix very easily with the ambient air, so that a closed inert gas layer would not provide reliable air exclusion either.

SUMMARY OF THE INVENTION

It is therefore an object of the invention to provide an apparatus for electrodepositing aluminum, in which the electrolyte can be kept under oxygen-free and water-free conditions.

According to the present invention, an apparatus of this type is provided which includes: a heatable treatment tank which is sealed airtight and to which an inert gas can be admitted; a rotatable electroplating drum arranged inside the treatment tank; a first tank, connected to the treatment tank for storing the electrolyte and a second tank, connected to the treatment tank, for storing a rinsing liquid.

With the apparatus according to the present invention, the electrolyte can be reliably protected from contact with the air at any time in the electroplating process. For this purpose, the treatment tank is first filled with dry inert gas and then with the rinsing liquid stored in the second tank, so that the air present is completely displaced. After replacing the rinsing liquid back into the second tank, only inert gas is still present in the treatment tank. Now the electrolyte stored in the first tank can be filled into the treatment tank without contamination. After the aluminum is deposited, the electrolyte is again stored in the first tank and the treatment tank is then charged with rinsing liquid for rinsing the articles to be plated, and the articles to be plated are rinsed clear of adhering electrolyte while the plating drum rotates.

The electrolyte is stored in a heatable first tank at the operating temperature required for the aluminizing, so that it need not first be heated before it is filled into the treatment tank.

The treatment tank is preferably connected to a third tank, the third tank being provided for storing a second rinsing liquid. By means of the second rinsing liquid, the plated articles are freed of electrolyte residue and hydrolysis products in the treatment tank. By use of the second rinsing liquid, the content of electrolyte and hydrolysis products in the first rinsing liquid is substantially reduced, so that a replacement of the first rinsing liquid is necessary now only after fairly long intervals of time.

Advantageously, the treatment tank is connected to the other tanks via feed pumps. The feed pumps make is possible to displace the electrolyte and the rinsing liquid rapidly and therefore, to accelerate the electroplating cycle.

In one embodiment of the apparatus according to the invention, a cover, at which the supports of the plating drum are fastened, is provided for closing off the treatment tank. For inserting and removing the articles to be plated, the cover need be lifted only far enough so that the plating drum is accessible. It is therefore no longer necessary to remove the plating drum separately.

Preferably, a reflux cooler is provided in the upper portion of the treatment tank. In the reflux cooler, solvent vapors rising from the electrolyte as well as vapors of the rinsing liquid are condensed and returned to the treatment tank. The losses of the several treatment liquids can thereby be kept extremely low.

It is advantageous to connect to the treatment tank a relief line, the end of which is immersed in an inert sealing liquid. The relief line is provided for the pressure relief of the treatment tank and for discharging the inert gas displaced by the different treatment liquids. The admission of air to the treatment tank is reliably prevented by the sealing liquid. The relief line immersed in a sealing liquid is distinguished by its simplicity over other possibilities for achieving pressure relief and equalizing volume variations of the inert gas, such as by connecting a gas tank filled with inert gas.

In accordance with further features of the present invention, the described apparatus is operated so that first, a water-free aprotic rinsing liquid is placed in the treatment tank and is subsequently relocated into the second tank, and that then the electrolyte is admitted into the treatment tank and returned to the first tank after the electrodeposition is finished. With this procedure, the air which penetrates into the treatment tank when the articles to be plated are placed in it is completely replaced by the rinsing liquid and the inert gas.

The plating drum with the articles to be plated is preferably immersed into the treament tank filled with the rinsing liquid. The articles to be plated, which are bare and free of cover layers after a suitable surface treatment and are wetted by a protective liquid, can be immersed in the rinsing liquid immediately after they are filled into the plating drum, before the rinsing liquid evaporates.

The treatment tank is advantageously filled, after the electrolyte is relocated, with a second, water-free, inert aprotic rinsing liquid. In this manner, the plating drum and the articles to be plated can easily be freed of residual electrolyte and hydrolysis products.

DETAILED DESCRIPTION OF THE INVENTION

Figure 1:
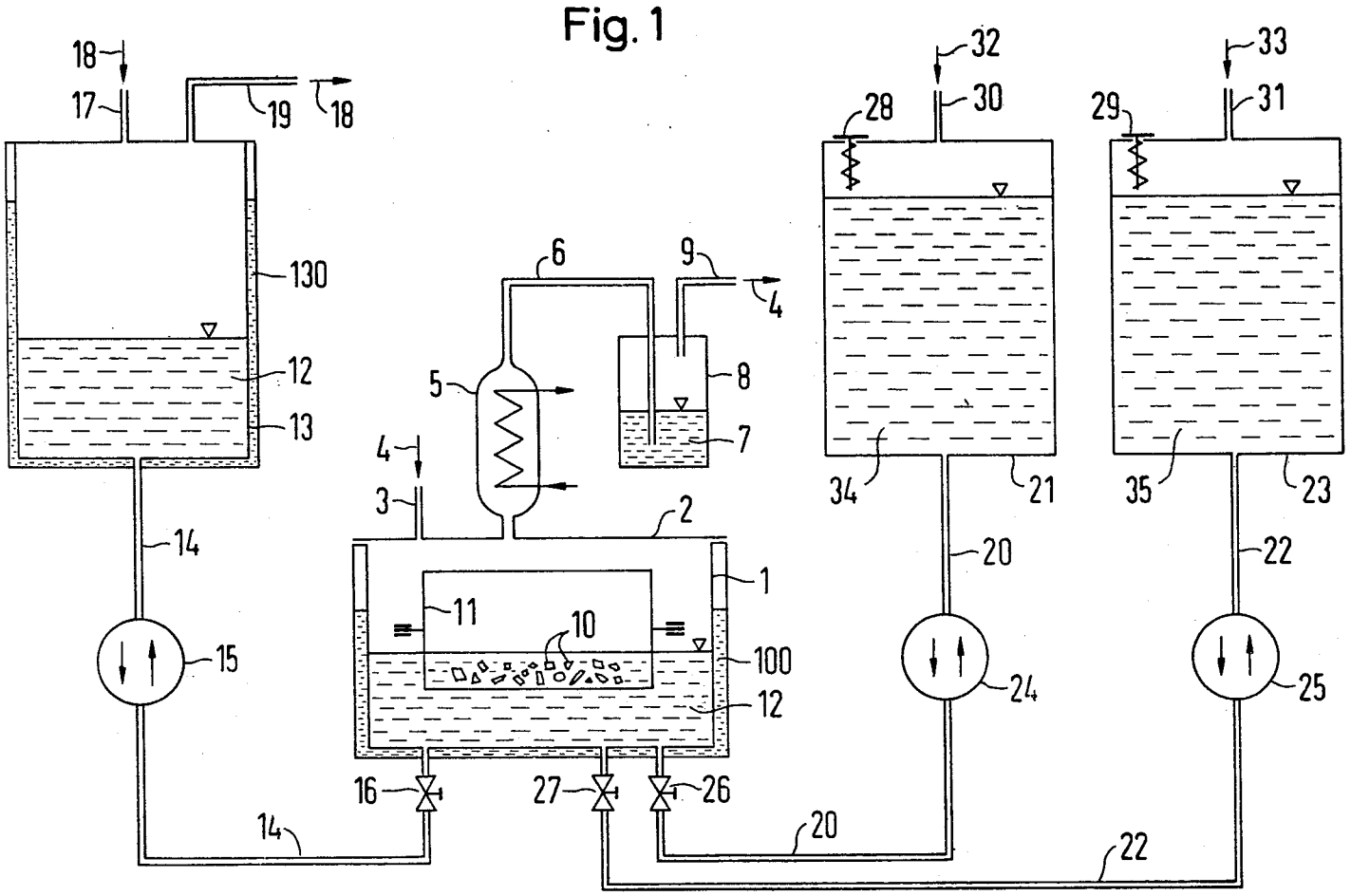
FIG. 1 is a schematic presentation of an apparatus for the electrodeposition of aluminum.

FIG. 1 shows a treatment tank 1, which is closed off by a cover 2 and to which inert gas 4 can be admitted via a feed line 3. The excess inert gas is conducted through an opening in the cover 2 into a reflux cooler 5, in which vapors that might be carried along are condensed, so that the condensate flows back into the treatment tank 1. From the reflux cooler 5, the excess inert gas 4 is conducted via a line 6 into an inert sealing liquid 7, such as, for instance, paraffin oil. The sealing liquid 7 is contained in a vessel 8 which is designed like a wash bottle and has an outlet 9 for the protective gas.

Inside the treatment tank 1, a rotatable plating drum is arranged, which contains the articles 10 to be electroplated and the lower part of which is immersed in an aprotic, oxygen-free and water-free organo-aluminum electrolyte 12. The treatment tank is surrounded by a heating bath 100 so that the electrolyte 12 can be kept at an operating temperature of 80° to 100° C. The electrolyte 12 is filled in from a closed tank 13 which is surrounded by a heating bath 130 and is connected to the treatment tank 1 via a line 14. A feed pump 15 and a valve 16 are disposed in the line 14. Inert gas 18 is admitted to tank 13 via a feed line 17 so that the electrolyte 12 in the tank 13 does not come into contact with air. The outlet 19, not further detailed, for the protective gas 18 can be run, as in the case of the treatment tank 1, via a reflux cooler and an inert sealing liquid.

The treatment tank 1 is further connected via a line 20 to a closed tank 21 and via a line 22 to a closed tank 23. The two lines 20 and 22 contain feed pumps 24 and 25 as well as valves 26 and 27. The tanks 21 and 23, which are equipped with overpressure valves 28 and 29 and to which inert gas 32 and 33, respectively, can be admitted via feed lines 30 and 31, are provided for storing rinsing liquids 34 and 35. The two rinsing liquids 34 and 35, under inert gas pressure, must be oxygen-free and water-free; aromatic hydrocarbons such as toluol and xylol are particularly well suited for this purpose.

The supply of the inert gases 4, 18, 32 and 33 may be interconnected; nitrogen, argon, krypton and gaseous hydrocarbons are suitable inert gases.

Feed pumps 15, 24 and 25 which can be switched, i.e., their directions of pumping can be reversed are preferably employed. However, pairs of pumps, which can be connected at will, with opposite pumping directions may also be used. Similarly, the pumping can be accomplished by acting upon the different liquid levels with the protective gas via an appropriate pressure control.

Before the articles 10 to be plated are placed in the apparatus described, they must be subjected to a pretreatment for creating bare surfaces, which are free of cover layers. A suitable surface pre-treatment is described, for instance, in U.S. Pat. application Ser. No. 419,233 filed Nov. 27, 1973. The subsequent aluminizing includes the following process steps:

a. the articles 10 to be plated, still wet with a protective liquid from the pre-treatment, are placed in the plating drum 11;
b. the plating drum 11 is immersed in the treatment tank 1 filled with the rinsing liquid 34 and the cover 2 is thereupon closed;
c. the rinsing liquid 34 is pumped back into the tank 21;
d. the electrolyte 12 is pumped from the tank 13 into the treatment tank 1 until the desired electrolyte level is reached;
e. the articles 10 to be plated are electroplated with aluminum while the plating drum 11 rotates;
f. the electrolyte 12 is pumped back from the treatment tank 1 into the tank 13;
g. the rinsing liquid 35 is pumped into the treatment tank 1 and the plated articles 10 are freed of electrolyte residue and hydrolysis products, while the plating drum 11 rotates;
h. the rinsing liquid 35 is pumped back into the tank 23;
i. the cover 2 is opened and the plated articles 10, coated with aluminum are removed from the plating drum 11.

Figure 2:
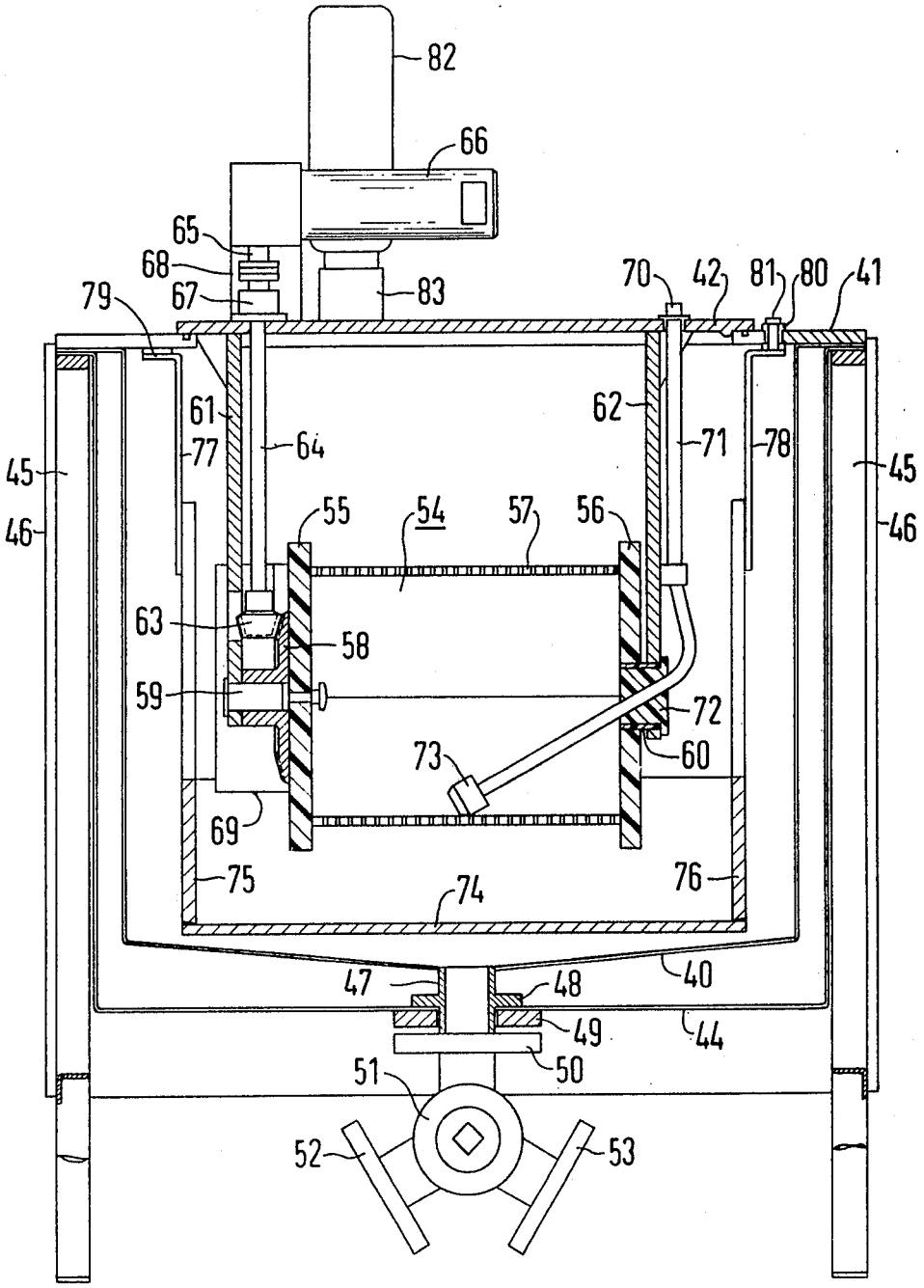
FIGS. 2 and 3 are a longitudinal view and a cross section, respectively, of an apparatus in accordance with the present invention without the required storage tanks.
Figure 3:
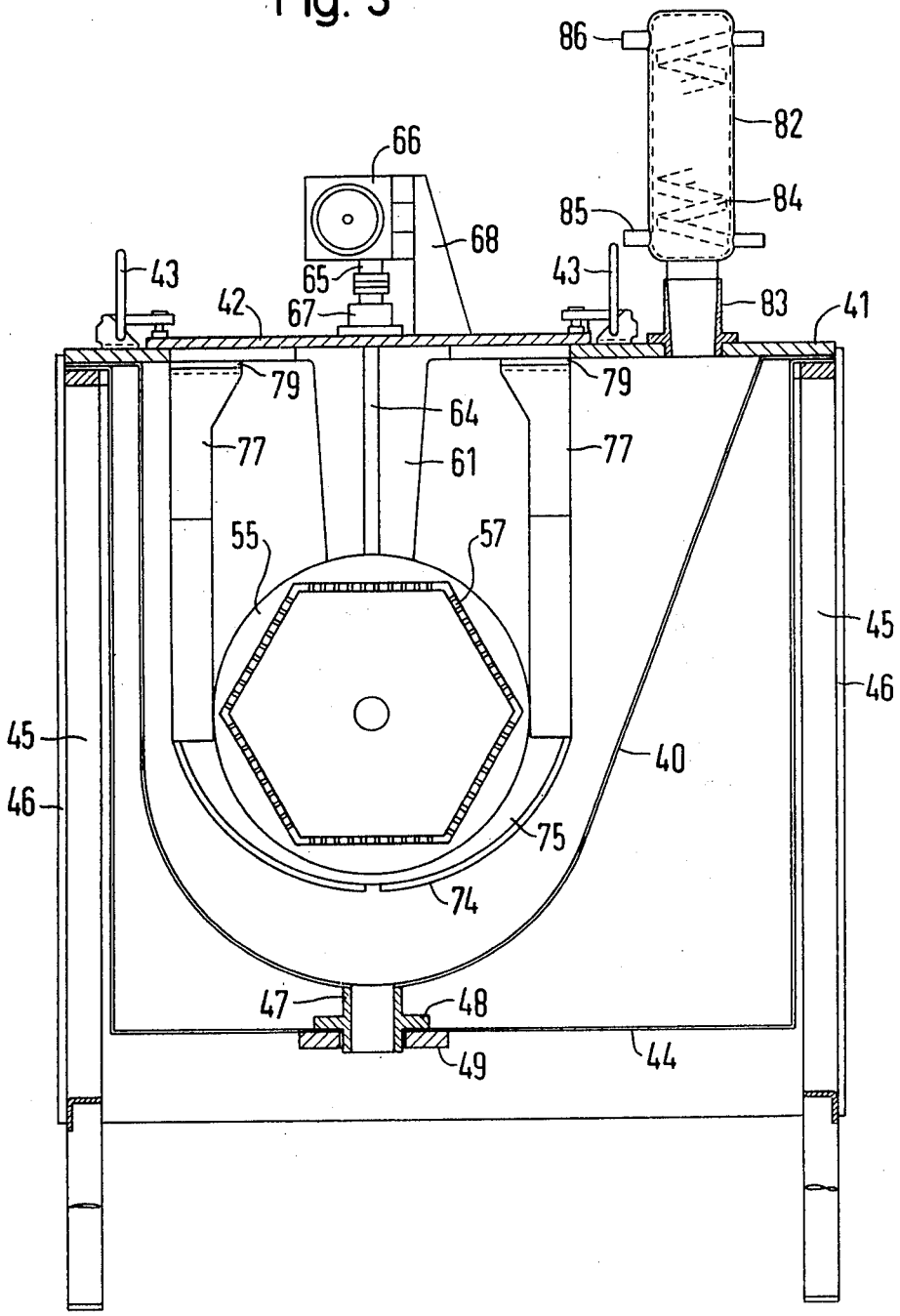

FIGS. 2 and 3 show an apparatus for electrodepositing aluminum, without the corresponding storage tanks, in a longitudinal and a cross section, respectively. The treatment tank 40 of this apparatus is closed by an upper cover plate 41, into which a cover 42 is fitted. The cover 42 is closed and opened by locking devices 43, which are fastened on the cover plate 41. The treatment tank 40 is hung in a heating tank 44 which contains a heating bath, e.g., an oil bath. The heating system, not shown in the drawing, of the heating bath may use, for instance, heater cartridges or a connection to a circulating heating system. The treatment tank 40 and the heating tank 41 are hung together in a frame 45 which is mounted on four legs and has an outer enclosure 46. For filling and emptying the treatment tank 40 with the different treatment liquids, a stub 47 which is brought through the bottom of the heating tank 44, is attached at its lowest point. For sealing, the bottom of the heating tank 44 is clamped between a shoulder 48 and an intermediate flange 49; the connecting flange 50 of a three-way valve 51 is bolted to the intermediate flange 49 at the same time. The two free connecting flanges 52 and 53 of the three-way valve 51 are provided for filling and emptying an electrolyte or different rinsing liquids.

An electroplating drum 54 which consists of two circular end walls 55 and 56 and a perforated drum case 57 of hexagonal cross section is disposed inside the treatment tank 40. For inserting and removing the articles to be plated, one side surface of the drum case 57 can be taken off. This is not shown in detail in the drawing, however. The plating drum 54 must be made of electrically insulating materials so that the electroplating process is not disturbed. Suitable materials are, for instance, phenolic plastic laminates with paper as the resin carrier. The end wall 55 is connected to a miter gear 58 which is rotatably supported on a journal 59, while the end wall 56 is rotatably supported in a bushing 60. The plating drum 54 is mounted inside the treatment tank 40 on support arms 61 and 62 which are rigidly connected to the cover 42 via the journal 59 and the bushing 60. The plating drum 54 is driven by a miter gear 63 meshing with the miter gear 58; its drive shaft 64 is brought through the cover 42 and is coupled to the drive shaft 65 of a motor 66 which is taken off vertically downward. The feed-through of the drive shaft 64 through the cover 42 is sealed by a stuffing gland 67, while the motor 66 is fastened to the cover 42 via a bracket 68. The miter gears 58 and 63 are covered by a cap 69 for protection against undesired deposition of aluminum.

The current is brought to the articles to be plated via a cathode terminal 70 and an insulated conductor 71, which is brought into the plating drum 54 through the inclined hole of an insert 72 of the bushing 60 and ends in a contact element 73. The feedthrough of the conductor 71 through the cover 42 is sealed. An anode 74, which is arranged in a circular arc at a distance from the plating drum 54 is bolted by means of supports welded to its end faces, to angles 77 and 78. These angles 77 and 78 are fastened to the cover 42 via an insulating spacer 79 and an insulating bushing 80. An anode lead 81 is connected to the angle 78 in a conducting manner through the insulating bushing 80.

Vapors rising from the treatment tank 40 are conducted into a reflux cooler 82, which has inlet stub 83 connected to the upper cover plate 41 of the treatment tank 40. The vapors are condensed at the cooling coil 84 of the reflux cooler 82, the condensate returning through the inlet stub 83 to the treatment tank 40. At the jacket of the reflux cooler 82, two connections are provided. The lower connection 86 is provided for feeding in a protective gas and the upper connection 86 for the discharge of excess protective gas and for the pressure relief of the treatment tank 40.

The apparatus described in the foregoing specification is particularly well suited for the batchwise aluminizing of small parts in mass production such as screws, nuts, washers and the like. The operation of the apparatus can be automated to a large degree.

We claim:

1. Apparatus for electrodepositing aluminum from aprotic, oxygen-free and water-free organo-aluminum electrolytes, comprising:

a. a heated treatment tank;
b. means to close said tank airtight;
c. means to admit an inert gas to said tank;
d. a rotatable electroplating drum arranged within said treatment tank;
e. a first tank for storing the electrolyte connected through a first valve and first pumping means to the treatment tank; and
f. a second tank for storing a rinsing liquid connected through a second valve and second pumping means to the treatment tank, whereby electrolyte and rinsing liquid may be transferred to and from said treatment tank by operation of said valves and pumping means.

2. Apparatus according to claim 1, and further including means to heat said first tank.

3. Apparatus according to claim 1 and further including a third tank for storing a second rinsing liquid connected to said treatment tank.

4. Apparatus according to claim 2 and further including feed pumps connecting said treatment tank to said first and second tanks.

5. Apparatus according to claim 1 wherein said means to close said treatment tank comprises a cover to which said electroplating drum is fastened.

6. Apparatus according to claim 1 and further including a reflux cooler in the upper portion of said treatment tank.

7. Apparatus according to claim 1 and further including a relief line the end of which is immersed in an inert sealing liquid connected to said treatment tank.

8. A method for electrodepositing aluminum from aprotic, oxygen-free and water-free organo-aluminum electrolytes comprising:

a. placing a water-free inert aprotic rinsing liquid in a treatment tank under an inert gas;
b. subsequently removing said rinsing liquid to a holding tank;
c. then placing the electrolyte in the treatment tank;
d. electroplating; and
e. transferring said electrolyte into a storage tank.

9. The method according to claim 8 and further including immersing an electroplating drum with the articles to be plated in the treatment tank when it is filled with said rinsing liquid.

10. The method according to claim 8 and further including the step of filling the treatment tank with a second water-free inert aprotic rinsing liquid after the electrolyte is transferred.

* * * * *